United States Patent [19]

Costa

[11] Patent Number: 4,469,242

[45] Date of Patent: Sep. 4, 1984

[54] DELIVERY MECHANISM FOR A VENDING MACHINE

[76] Inventor: Ralph J. Costa, Eight Mulberry St., Old Saybrook, Conn. 06475

[21] Appl. No.: 433,982

[22] Filed: Oct. 6, 1982

[51] Int. Cl.[3] ..... G07F 11/00

[52] U.S. Cl. ..... 221/4; 221/75; 221/114; 74/417

[58] Field of Search ..... 221/2, 4, 75, 112, 114, 221/115, 116, 222; 192/67 R, 95; 74/417

[56] References Cited

U.S. PATENT DOCUMENTS

| | | | |
|---|---|---|---|
| 1,466,595 | 8/1923 | Mabey | 74/417 |
| 2,556,740 | 6/1951 | Polsen et al. | 221/222 |
| 3,209,940 | 10/1965 | Gustwa et al. | 221/4 |
| 3,810,560 | 5/1974 | Stegemar | 221/116 |
| 4,426,016 | 1/1984 | Croteau et al. | 221/75 |

FOREIGN PATENT DOCUMENTS

| | | | |
|---|---|---|---|
| 1297910 | 5/1962 | France | 221/75 |

*Primary Examiner*—H. Grant Skaggs

*Attorney, Agent, or Firm*—Hayes & Reinsmith

[57] ABSTRACT

A vending apparatus is disclosed which is adjustable for delivering products of different sizes and shapes and which is particularly suited for easy field conversion or changeover for a desired product delivery. The vending apparatus includes a plurality of identical rotary dispensing shafts each having a helical scroll with the dispensing shafts vertically disposed in an aligned array. To establish a preselected drop-off for a given product, the dispensing shafts are each angularly adjustable relative to one another. A power operated, rotary actuator shaft is provided with a plurality of gears fixed on the actuator shaft. The actuator shaft gears are meshingly engageable respectively with a corresponding gear on each dispensing shaft. For ease of product delivery changeover, the actuator shaft gears are also each retractable into an adjust position in disengaged position to its respective dispensing shaft gear whereby the relative angular position of that dispensing shaft may be selectively adjusted for product delivery changeover.

20 Claims, 13 Drawing Figures

FIG. 1A
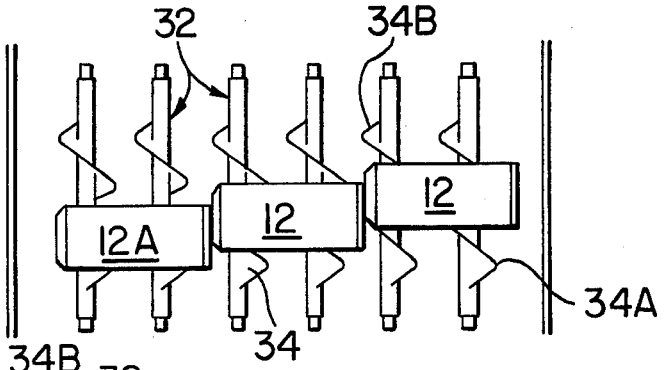
FIG. 1B
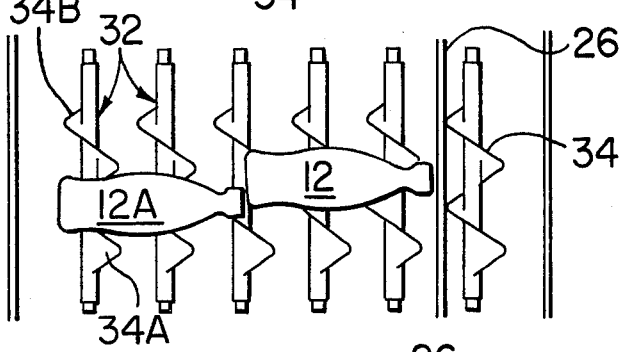
FIG. 1C
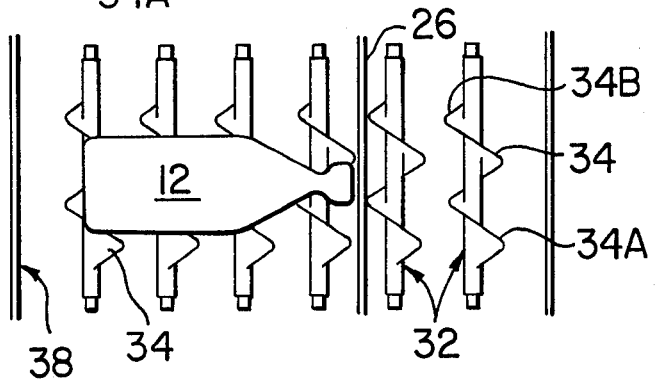
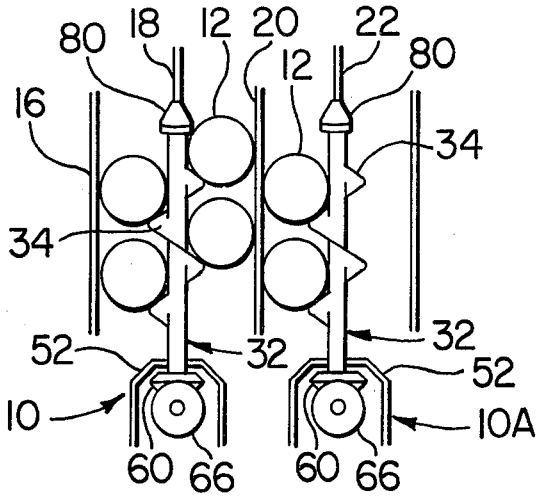
FIG. 2

DELIVERY MECHANISM FOR A VENDING MACHINE

FIELD OF THE INVENTION

This invention generally relates to vending machines and is particularly concerned with a delivery mechanism for dispensing a single article at a time from selected racks of articles which are disposed in either single or double columns which columns are formed in either single or multiple stack depth arrangements.

BACKGROUND OF THE INVENTION

In the known vending machines, a variety of different product storage and release mechanisms are provided for product delivery operations. An ultimate aim of any party installing a vending machine is to provide such a machine which is selectively adjustable to vend either cans or glass bottles, e.g., in a maximum of different selections for a given machine size while serving to also vend a minimum percentage of a particular selected product to meet certain anticipated demands. A machine will desirably be adjustable for both single and double column arrangements which, depending on the size bottle or can, such columns will be single, double or even triple depth stack arrangements. With maximum machine adjustability, a user of a vending machine then may load the machine to provide a particular product of reduced consumer demand in a single column or provide a greater selection of different flavors in either single or double columns, while at the same time, maximizing use of the machine to include a larger percentage of machine capacity to selected flavors of high demand.

Among known prior art machines, Ural U.S. Pat. No. 3,463,355, Baxendale U.S. Pat. No. 3,799,393 and Payne U.S. Pat. No. 4,335,832 disclose typical vending apparatus for selective product storage and release. These machines provide refrigerated chests having coin-actuated release mechanisms for dispensing a single container, such as a can or glass bottle, one at a time. As shown in the referenced patents, such chests employ a dispensing apparatus having two adjacent front-to-back staggered stacks of containers with corresponding containers in the respective adjacent stacks being substantially axially aligned relative to one another.

However, because of a particular type dispensing mechanism peculiar to a given vending machine, known vending machines are frequently limited to a double column arrangement or a single column, double depth stack arrangement, for example, or other such limitations which do not meet certain field requirements for machine capacity, versatility and adjustment wherein either single or double columns and either single or multiple stack depth arrangements may be programmed by an operator for maximum machine versatility and flexibility in the flavor section.

Moreover, in known vending machines, when it is desired to vary a product delivery or to effect a so-called field conversion or changeover, the complexity of known vending release mechanisms introduces excessive operator time and skill requirements and downtime on the part of the machine in addition to possibly requiring replacement of a host of different parts which are necessary to be substituted to change a given product delivery, for example, to a different size container. It is not unknown, e.g., to require different dispensing mechanisms within a given machine which includes different drive motors and actuating components. When a change is desired to convert a single column or a double column to a different stack depth arrangement, prior art machines may require actual substitution of certain drive and/or actuating components. The devices utilized for timing the release of such containers are likewise frequently of a type requiring a skilled operator and necessitating manual disassembly and subsequent re-assembly of the vending apparatus or its major components to effect changeover.

SUMMARY OF THE INVENTION

This invention discloses a vending apparatus which, by an exceedingly simple adjustment, will adapt the machine to vend either cans or bottles in a variety of different sizes while ensuring maximum use of the machine capacity. In general, the machine has an upstanding compartment to confine and guide cans and bottles, and an array of rotary dispensing shafts with a helical scroll are provided at the bottom of each column of articles to store those articles and release the bottom article of a column in response to a signal from a control system which is coin actuated or otherwise suitably activated.

Each compartment includes a movable wall which can be set in an adjusted position to establish a front-to-rear depth desired for a single, a double or even a triple stack depth arrangement of articles to be dispensed. In the delivery mechanism of this invention, a motor-driven actuating means, specifically an actuator shaft having a plurality of gears fixed thereon, operates to drive its array of rotary dispensing shafts in a common angular direction. Each dispensing shaft has a gear fixed thereon which is meshingly engageable with a gear of the actuator shaft.

When the actuator shaft is driven to dispense a can or bottle, a control system incorporating a timing control circuit rotates the actuator shaft through a predetermined angular displacement whereby a selected can or bottle will reach a drop-off point on the scroll(s) of the dispensing shaft(s) to effect product delivery. Such action is effected by the gear drive between the actuator shaft and each of the dispensing shafts.

The subject invention additionally features a unique arrangement wherein each gear of the actuator shaft is retractable into an adjust position in disengaged relation to its dispensing shaft gear for selectively adjusting the relative angular position of that dispensing shaft for a product delivery changeover without requiring removal of any component of the vending apparatus or its disassembly from the machine. With the actuator shaft gear retracted into an adjust position, the dispensing shaft associated with that particular actuator shaft gear is individually freewheeling so as to be rotatable manually to a predetermined angular position programmed for a given product delivery.

In the disclosed embodiment of this invention, the dispensing shafts are each of identical size and shape and are formed with an identical scroll and are operated in a common angular direction upon rotation of the actuator shaft and are interchangeable; likewise, each gear of the dispensing shaft and each gear of the actuator shaft are of identical pitch, size and shape and are interchangeable, thereby providing a vending apparatus which not only is economical to manufacture and assemble, but is particularly quick and easy to service with a minimum number of different operating components for exceptionally facile changeover requiring significantly reduced skill and time requirements on the part of a serviceman.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principle of the invention is employed.

BRIEF DESCRIPTION OF THE DRAWINGS

FIGS. 1A, 1B and 1C are schematic representations, respectively, of a triple, double and single stack depth arrangement of articles to be dispensed;

FIG. 2 is a schematic front-end view of a double column and single column of articles in a compartment of a vending machine incorporating this invention;

DESCRIPTION OF PREFERRED EMBODIMENTS

Figure 3:
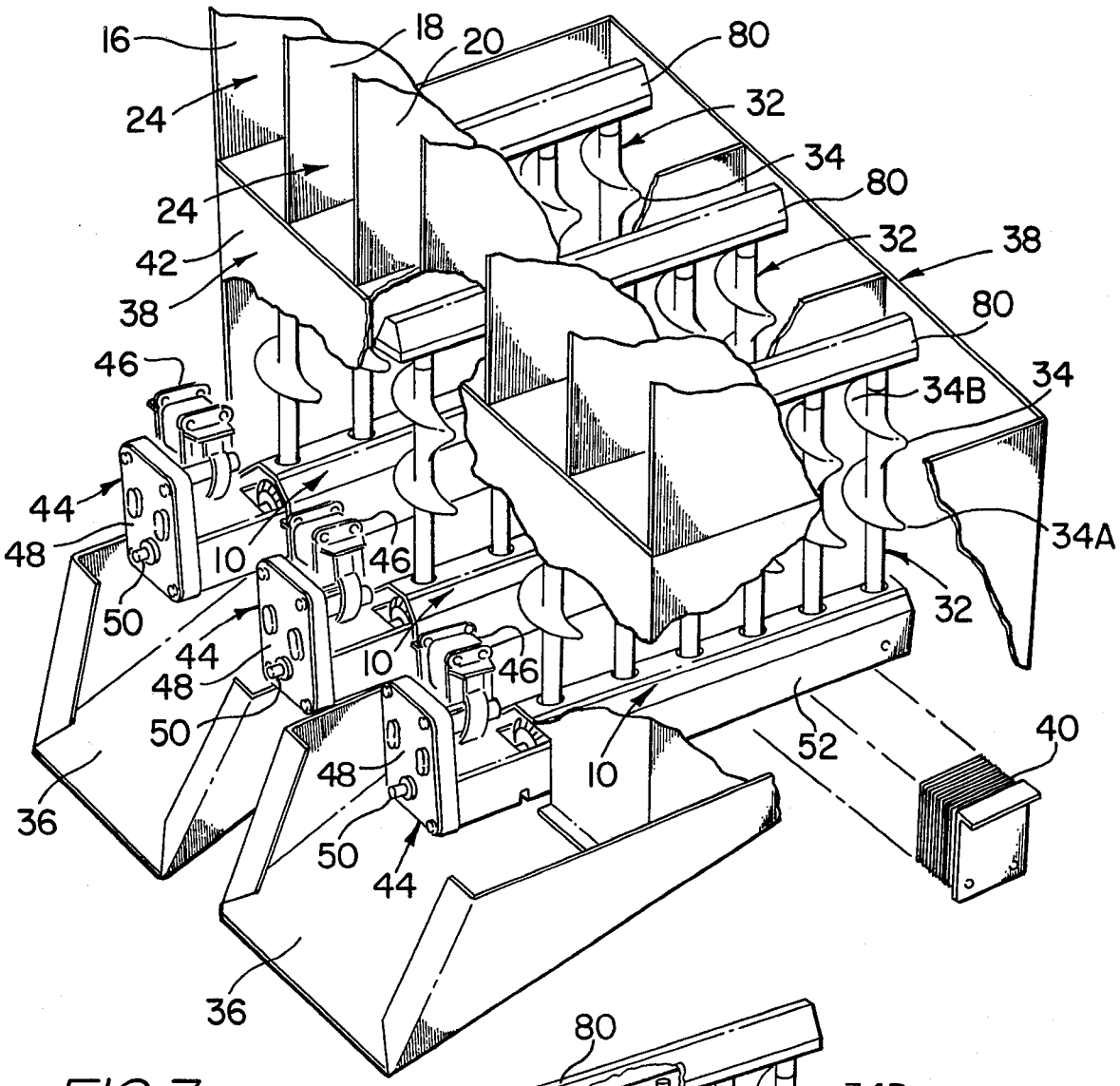
FIG. 3 is an isometric view, partly broken away, showing a vending apparatus incorporating this invention with three individual dispensing mechanisms in side-by-side relationship.

Referring to the drawings and particularly to FIGS. 1 and 2, articles of different sizes and shapes are shown in single and double columns in single, double and triple stack depth arrangements. In FIGS. 1A, 1B and 1C, side view stack depth arrangments are schematically depicted respectively for triple depth, double depth and single depth stack arrangements of containers such as cans, bottles or other containers hereinafter for convenience referred to as "cans". FIG. 2 schematically depicts a front view of a pair of side-by-side dispensing mechanisms 10, 10A. Dispensing mechanism 10 has a double column arrangement of cans 12, each of which will be understood to be the same size and shape and contain the same flavor beverage. The cans 12 are in overlying relation to one another with the double column defined by front-to-rear, laterally spaced partitions 16, 18 and 20; and a single column can arrangement is shown in dispensing mechanism 10A wherein the single column is defined by partitions 20 and 22. Vending machines are normally provided with a plurality of upstanding product storage compartments such as at 24 (FIG. 3), in overlying relation to their respective dispensing mechanism, with each compartment 24 (defined by partitions as described above) for receiving and storing a given size and shape of cans containing a particular beverage or flavor and for guiding the same to a lowermost position in its respective dispensing mechanism to effect release and delivery of a bottom can (12A in FIGS. 1A and 1B) in response, for example, to a coin operated control system (not shown). A laterally extending rear wall partition (such as at 26 in FIGS. 1B and 1C) will be understood to be provided for each compartment 24 and may be adjustably fixed therein to establish the front-to-rear depth for a single, double or triple depth stack arrangement of the cans 12 which are shown in FIGS. 1A and 1B in multiple depth stack arrangements generally in end-to-end relation. In the preferred embodiment, bridging of cans between columns is preferably avoided by having partitions as described extending between such columns whereby the cans are maintained in overlying relation to one another during storage.

When a can such as 12A is being dispensed, a motor driven, rotary actuator shaft 30 is rotated within a selected dispensing mechanism 10 controlling the column of cans 12 containing that particular selected flavor. Shaft 30 operates to rotate through a predetermined cycle to in turn rotate an array of drivingly connected dispensing shafts 32, each of which have an identical helical protrusion or scroll 34 for product storage and release, whereby a single can is dispensed upon rotation of the actuator shaft 30 through that predetermined cycle or angular displacement to cause a lowermost can such as 12A in a selected column to pass a "drop-off" point 34A on the dispensing shaft scroll(s) 34 to release the can 12A into an underlying chute 36. The remaining cans in a column, from which a selected lowermost can is dispensed, are lowered under the force of gravity during rotation of the dispensing shafts 32 controlling that particular column of cans, to permit each of the stored cans to move downwardly in its respective column and sequentially enter an upper lead end 34B of the helical scroll or scrolls 34 on its respective dispensing shaft or shafts 32 and thereafter to pass through the dispensing mechanism 10 during its subsequent cycling to be ultimately delivered into chute 36.

In the specifically illustrated embodiment, a plurality of dispensing mechanisms 10 are illustrated in FIG. 3 wherein each unit will be understood to be identical and for purposes of this invention only one dispensing mechanism 10 will be described. It will be understood that the dispensing mechanisms 10 and their associated compartments 24 may be arranged in various side-by-side units of six or seven, e.g., depending on width limitations for a given machine. Each dispensing mechanism 10 includes the described motor driven actuator shaft 30 which is horizontally mounted within its mechanism 10 which is in fixed relation to a frame 38 for controlling an array of aligned dispensing shafts 32 vertically disposed in perpendicular relation to the actuator shaft 30.

Figure 4:
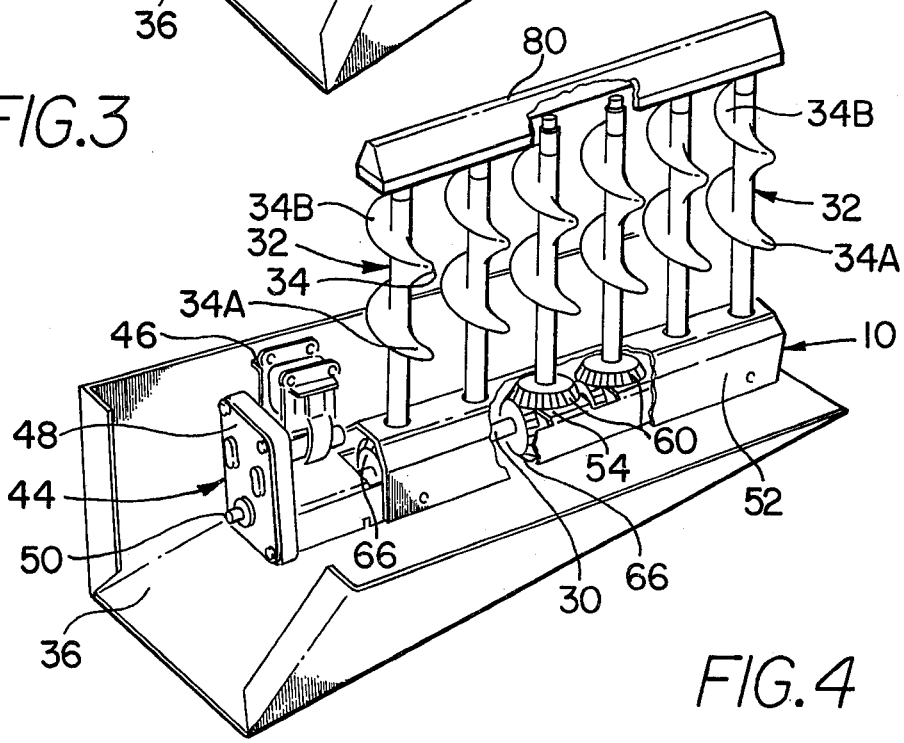
FIG. 4 is an isometric view, partly broken away, showing certain features of one of the dispensing mechanisms of FIG. 3.

As best seen in FIGS. 3 and 4, each dispensing mechanism 10 is associated with a chute such as at 36 which may serve a plurality of columns and their respective dispensing mechanisms with the chute 36 being secured to frame 38 of the vending machine in underlying relation to one or more dispensing mechanisms 10 for receipt and delivery of various selected cans 12 one at a time. As seen in FIG. 3, suitable refrigerating equipment, including refrigerating coils 40, is preferably provided at the base of the machine, and the frame 38 will be understood to include an interior front panel 42 which shrouds the front of the vending apparatus rearwardly of each of its drive mechanisms 44.

Figure 5:
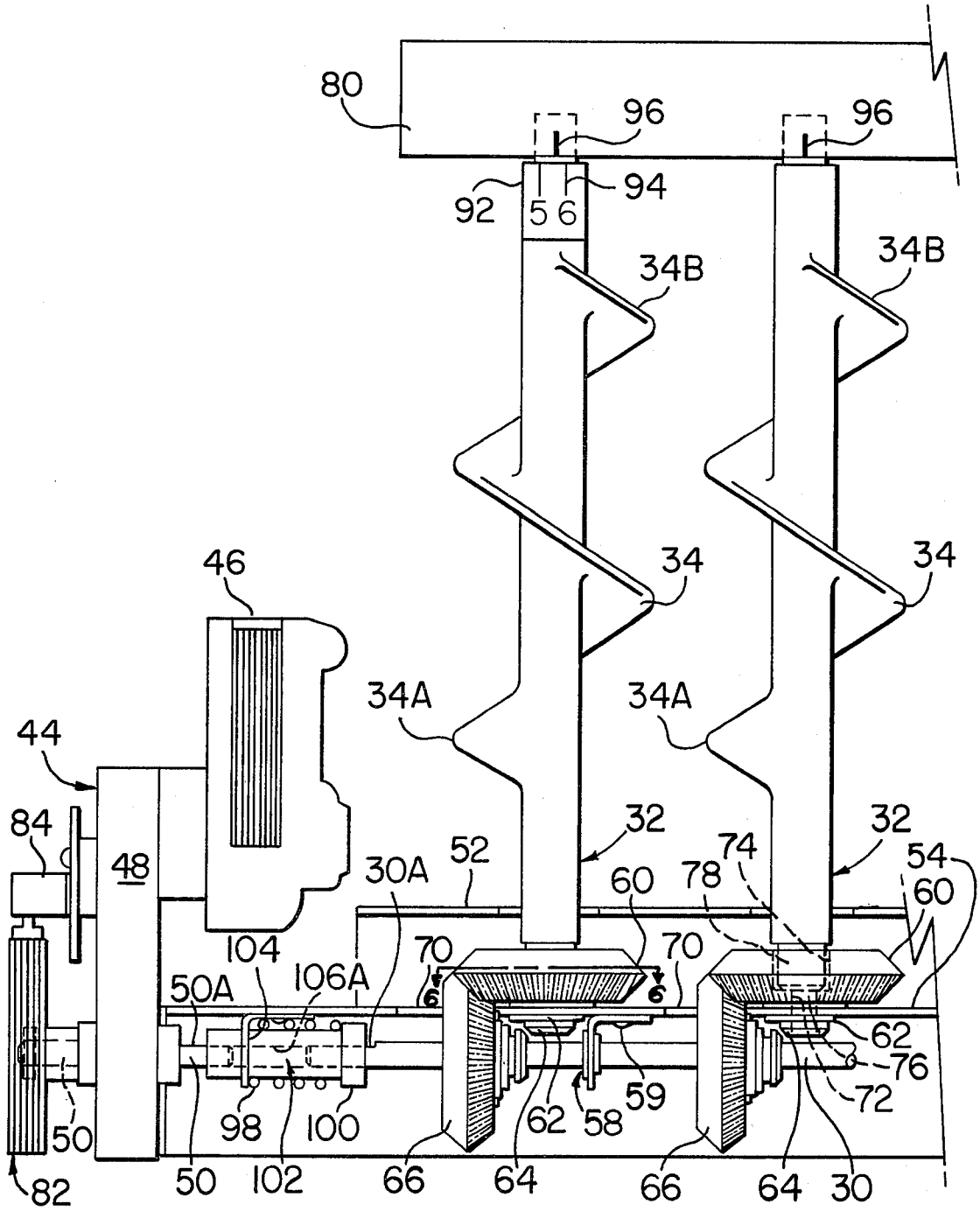
FIG. 5 is a side elevational view on an enlarged scale, partly broken away, showing certain features of a dispensing mechanism incorporating this invention with gears of an actuator shaft and dispensing shafts in meshing engagement.

Each drive mechanism 44 includes suitable control circuitry, not shown, a conventional motor 46 and an associated gear train serving as a speed reducer or speed change device which is also of conventional design. The speed change device is supported within housing 48 and has an output drive shaft 50 drivingly connecting motor 46 to actuator shaft 30. The motor 46 and speed change mechanism housing 48 are mounted as an integral unit to mechanism 10 in fixed relation to frame 38 with drive shaft 50 extending rearwardly under a cover 52 and into the confines of its associated dispensing mechanism 10 below a mounting plate 54 (FIG. 5).

The mounting plate 54 is elongated and includes a plurality of suitable bearing assemblies such as at 58 fixed by a fastener 59 to mounting plate 54. Bearings 58 support the power operated actuator shaft 30 for rotation and for relative axial reciprocation within bearings 58. Mounting plate 54 further includes a plurality of horizontally disposed dispensing shaft miter gears 60, which in the preferred embodiment will be understood to be six in number, two of which are illustrated in FIGS. 4 and 5. Gears 60 are equally spaced apart along a major longitudinal axis of the mounting plate 54 with each gear 60 supported upon the mounting plate 54 for rotation about a vertical axis and maintained in position by a suitable retaining ring 62 (FIG. 5) fixed to a reduced diameter coaxially extending shaft 64 integrally secured to each gear 60 and disposed below mounting plate 54.

In accordance with one feature of this invention wherein each dispensing mechanism 10 may be specifically designed to reduce the number of different parts and to introduce a heretofore unknown simplicity in the manufacture, assembly and servicing of an exceptionally versatile vending machine, the dispensing shaft gears 60 of each individual dispensing shaft array are intentionally designed to be rotated in a common angular direction. For driving the dispensing shaft gears 60, a plurality of mating miter gears 66 are mounted in fixed relation by any conventional means, not shown, to actuator shaft 30 for rotation about a horizontally disposed axis defined by actuator shaft 30 on which gears 66 are secured. Suitable apertures 70 of oversized dimension, relative to actuator shaft gears 66, are formed in mounting plate 54 for receiving actuator shaft gears 66 which, as shown in FIGS. 4 and 5, partially project upwardly above mounting plate 54 within the confines of cover 52 and into meshing engagement with dispensing shaft gears 60.

Figure 6:
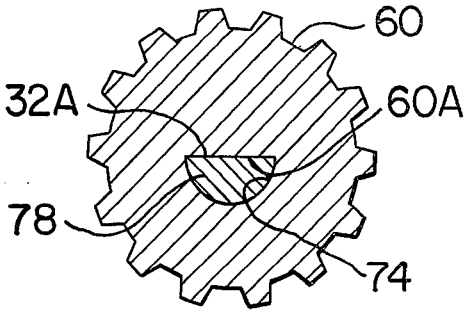
FIG. 6 is an enlarged cross-sectional view taken generally along line 6—6 of FIG. 5.

To establish a driving connection between each of the dispensing shafts 32 and their respective gears 60, each dispensing shaft gear 60 is provided with a central bottom aperture 72 having an enlarged communicating upper opening 74 having a generally D-shaped cross section (FIG. 6). As best seen in FIGS. 5 and 6, a lower terminal end 76 of reduced diameter is provided on each dispensing shaft 32 and supported in the central aperture 72 of its gear 60. Each dispensing shaft 32 also has a drive segment 78 above its reduced terminal end 76 with the drive segment 78 having a D-shaped cross section corresponding to the generally D-shaped upper opening 74 of its gear 60 whereby mating flats 60A, 32A (FIG. 6) of the gear 60 and shaft 32 serve as a driving connection upon rotation of each actuator shaft gear 66 to effect a following angular movement of its dispensing shaft 32.

In view of the above disclosed structure, rotation of actuator shaft 30 in a selected angular direction transmits a simultaneous driving rotary movement to each of its gears 66 to in turn rotate gears 60 of the array of dispensing shafts 32 to drive those shafts 32 in a common angular direction through a predetermined angular displacement necessary to dispense a lowermost bottom can 12A of a column which is of a selected flavor in response to a coin operated signal received from the control system. Frame 38 includes a tie bar 80 in overlying relation to the array of dispensing shafts 32 of each individual dispensing mechanism 10. Tie bar 80 provides bearing support for an upper end of each dispensing shaft 32 for supporting the same for rotation about its respective vertical axis.

As more fully described in copending U.S. patent application Ser. No. 433,014 filed in the name of Ralph J. Costa, entitled "Cycling Control Cam for a Vending Machine Delivery Mechanism" and assigned to the assignee of this invention, a cycling control cam 82 (FIG. 5) is provided for each individual dispensing mechanism 10 and is supported on drive shaft 50 in operative relation to a vend cycle control switch 84 which will be understood to control circuitry, not shown, for controlled cycling of its respective dispensing mechanism 10.

For an understanding of this invention, it will suffice to understand that the vending control circuitry of a dispensing mechanism 10, which controls delivery of a single or double column of product of a particular flavor, may be coin operated, for example, to effect motor energization and initiate rotation of output drive shaft 50, via its associated speed change mechanism, to rotate actuator shaft 30 and dispensing shafts 32. Vending control circuitry effects angular rotation of the dispensing shaft array through a predetermined angular displacement whereby a lowermost can 12A of a column is discharged during the cycling movement of control cam 82. Control cam 82 serves to actuate vend cycle control switch 84, following discharge of a selected can 12, to de-energize a vending circuit of the control circuitry and energize a reset circuit thereof, therby maintaining continued motor operation to drive a lobe, not shown, of cam 82 to ride past switch 84 and to cause that switch 84 to de-energize the reset circuit and condition the control system for a next following dispensing operation.

As described, each dispensing shaft 32 must be individually selectively positioned in angular relation to the other dispensing shafts 32 of its array for dispensing product of a particular columnar and stack depth arrangement in accordance with a predetermined timing formula. Such formulas, while not a part of this invention, will be understood to be pre-selected in reference to a given size and shape of cans 12 to be stored and thereafter released for the machine on signal from its control system. The described identical construction and common angular directional movement of each dispensing shaft 32 in each array, however, significantly facilitates formulation of the timing programming which is then readily synchronized with different cycling control cam operating modes for dispensing product from different columns of the machine in a variety of container sizes and shapes.

Known conventional devices require significant operator time and skill requirements to effect field conversion or changeover of the vending apparatus for any given product delivery different from that for which the vending apparatus has been previously set. Such known devices require in certain cases disassembly and, frequently, further dismantlement of key components of the delivery apparatus to provide a desired adjustment for a given product delivery. In addition, such apparatus often employs customized components wherein individually different operating parts must be provided for different product deliveries and specifically requires precise angular adjustments upon replacement and reassembly of the various parts for a desired vending operation.

In accordance with this invention, the disclosed vending apparatus is particularly suited for quick and easy adjustment for delivering products of different sizes and shapes. The vending apparatus is specifically designed to maintain each actuator shaft gear 66 in a normal vend position (FIGS. 4 and 5) engaging a gear 60 of a dispensing shaft 32 for a given product delivery of containers of a given size and shape. For selectively adjusting the relative angular position of each dispensing shaft 32 for a product delivery changeover to containers of a different size and shape, each gear 66 of actuator shaft 30 is retractable to an adjust position in disengaged relation to its dispensing shaft gear 60 (FIG. 10) wherein dispensing shafts 32 are each individually freewheeling when its respective actuator shaft gear 66 is in retracted (and disengaged) adjust position. Thus, each dispensing shaft 32 is independently rotatable to a predetermined angular position for a given product delivery.

Figure 10:
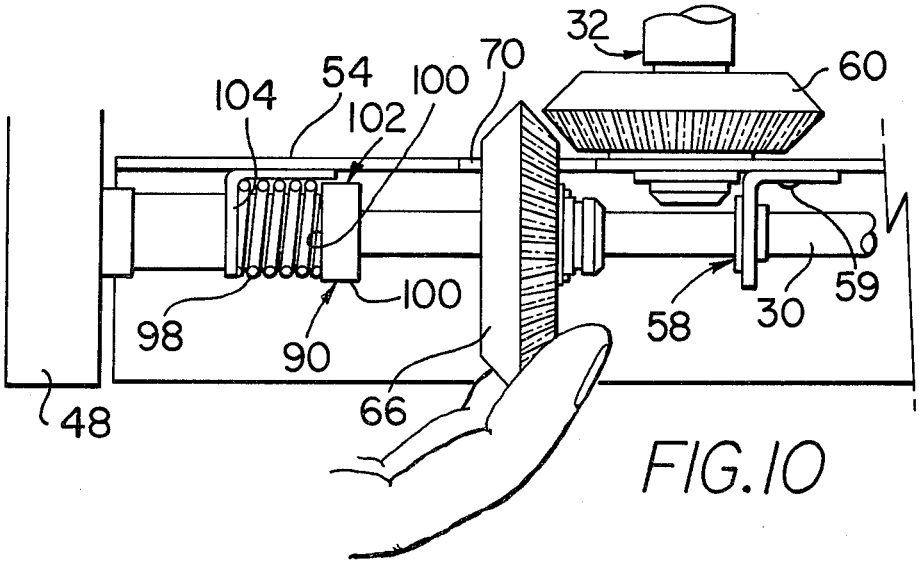
FIG. 10 is a view similar to FIG. 5 but showing the gears of the actuator shaft and dispensing shaft disengaged and positioned in a retracted adjust position.

In the specifically illustrated embodiment, actuator shaft 30 and its gears 66 are designed to be conveniently movable as an entity between the described vend and adjust positions illustrated respectively in FIGS. 5 and 10 by virtue of a clutch 90 incorporated in this invention. As illustrated, actuator shaft 30 and its gears 66 are reciprocable within bearings 58 relative to the major axis of actuator shaft 30 between vend and adjust positions, by simply manually retracting an actuator shaft gear 66 from its normal vend position (FIG. 5) into retracted adjust position (FIG. 10), such action being facilitated by clutch 90 as described fully below. Such action is readily accomplished upon opening an exterior door, not shown, of the vending machine, whereupon an operator may simply reach into a space below each dispensing mechanism 10 and within the confines of its chute 36 to disengage actuator shaft gears 66 from their respective dispensing shaft gears 60, freeing each dispensing shaft 32 for individual freewheeling. The operator then may reach into the delivery chute area and engage each dispensing shaft 32 above cover 52 to rotate that shaft into a preselected angular position in accordance with a predetermined program selection for a given product delivery to establish a desired relative position for each dispensing shaft 32 in relation to the other shafts 32 in its dispensing shaft array for dispensing cans 12 in accordance with an established loading of the machine depending on the size and shape of the containers and their arrangements relative to one another as to single or double column and specified stack depth. This action is further facilitated by a timing band illustrated at 92 in FIG. 5 which will be understood to be mounted on each dispensing shaft 32 and may be marked with suitable indicia 94 to establish a desired angular position of each dispensing shaft 32 in reference to a fixed reference mark, such as at 96, provided on tie bar 80.

To accommodate the described vending apparatus adjustment, drive mechanism clutch 90 includes resilient biasing means cooperating with clutch 90 to normally maintain actuator shaft 30 in its vend position with actuator shaft gears 66 in meshing engagement with dispensing shaft gears 60. The resilient biasing means in the illustrated embodiment includes a compression spring 98 having opposite ends seated against an enlarged collar 100 on an inboard end of a coupling 102 of the clutch 90 and a spring bracket 104 fixed to and depending from mounting plate 54. Clutch coupling 102 is movable against the biasing force of spring 98 upon axially moving actuator shaft 30 manually from its normal vend position to retracted adjust position, and spring 98 effects a resilient biasing force on actuator shaft 30 upon manually releasing it after a desired adjustment to return actuator shaft 30 to its adjusted, normal vend position and thereafter maintains its gears 66 in meshed engagement with dispensing shaft gears 60 and with shafts 32 in adjusted angular positions relative to one another for a selected product delivery.

Figure 7:
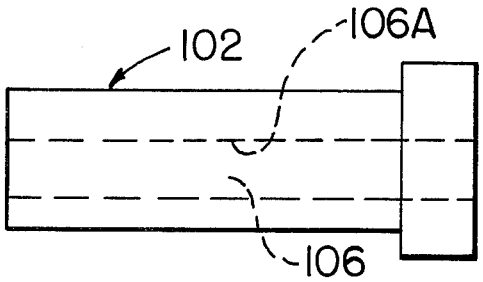
FIG. 7 is an enlarged side view of a clutch incorporated in this invention.
Figure 9:
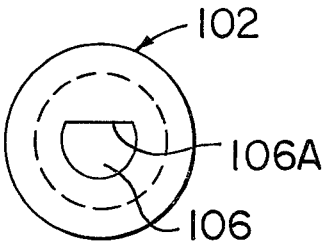
FIG. 9 is a right-hand end view of the clutch of FIG. 7.
Figure 8:
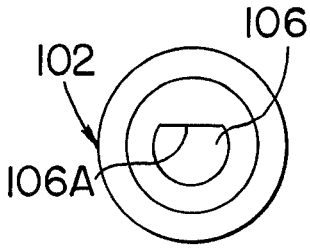
FIG. 8 is a left-hand end view of the clutch of FIG. 7.

The specifically illustrated embodiment of coupling 102 in FIG. 5 incorporates a uniformly configured through opening 106 (FIGS. 7–9) of generally D-shaped cross section within clutch coupling 102 wherein a correspondingly shaped end of change speed mechanism output drive shaft 50 having a flat 50A is received in driving engagement with a flat 106A formed within coupling 102 to transmit a rotational driving force to clutch coupling 102. An input end of actuator shaft 30 is likewise formed with a D-shaped cross section and a driving flat 30A (FIG. 5) which is received within clutch coupling opening 106 for transmission of rotary movement from coupling 102 to actuator shaft 30 in response to coupling 102 being rotated by output drive shaft 50.

By such construction, clutch coupling 102 accommodates relative axial movement of actuator shaft 30 within the confines of coupling 102 while continuing to maintain its rotary driving connection to output drive shaft 50. If drive mechanism 44 were to be removed from mechanism 10, for any reason, the disclosed spring bracket 104 will be seen to retain coupling 102 and its compression spring 98 in operative position with actuator shaft 30 during such removal.

Accordingly, adjustment of the vending apparatus of this invention for different product delivery is quickly and easily achieved with a minimum amount of time and skill required on the part of an operator. The disclosed construction is particularly suited to permit economical manufacture and assembly wherein each motor and associated drive mechanism is identical as is each dispensing mechanism. Each of the dispensing shafts 32 may be formed with an identical helical scroll 34 having a common lead and a common drop-off point. In addition, the dispensing shaft gears 60 and actuator shaft gears 66 are intentionally and purposely designed to be of identical construction wherein the gears of each of the dispensing and actuator shafts are of identical size and shape and are of identical pitch and interchangeable.

Figure 11:
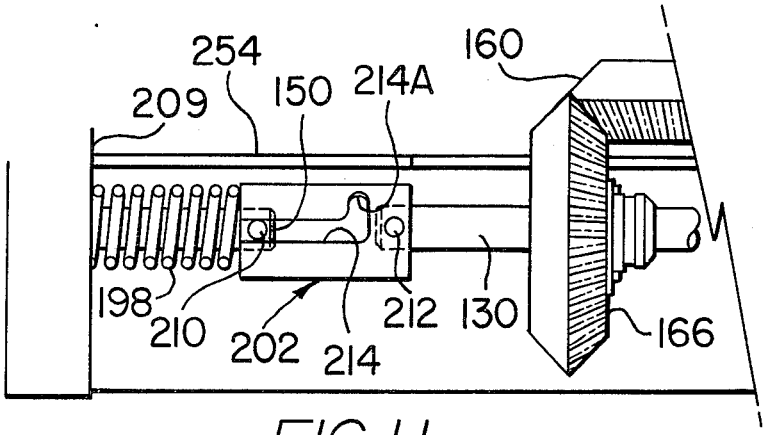
FIG. 11 is a side view, partly broken away, showing another embodiment of the clutch incorporated in this invention.

As seen in FIG. 11, another embodiment of a clutch coupling 202 is illustrated wherein a compression spring 198 is coiled about output drive shaft 150 and opposite ends of spring 198 are seated against a fixed member 209, and against an outboard end of clutch coupling 202. The latter is rotatably coupled to output drive shaft 150 and actuator shaft 130 respectively by pins 210 and 212. Output drive shaft pin 210 is received in an axially extending bayonet slot 214, formed in coupling 202, for movement relative to coupling 202 upon retraction of actuator shaft 130 and its gears such as at 166 into a retracted adjust position as described above in connection with the embodiment of FIG. 10. By virtue of bayonet slot 214 in coupling 202, actuator shaft 130 may be angularly rotated in retracted position to temporarily secure actuator shaft 130 within coupling 202 upon engaging pin 210 within a radially extending end opening 214A of slot 214 which serves as a retaining means. Adjustment of the angular positions of the associated dispensing shafts such as at 160 accordingly may be facilitated without manually restraining actuator shaft 130.

In addition to manufacturing and assembly advantages and significantly improved ease of changeover adjustment and servicing by an operator, the disclosed invention provides a further feature with heretofore has eluded manufacturers of known vending devices. Namely, this invention not only provides for facile manufacture, assembly and servicing, but additionally provides a construction which is uniquely compatible for dispensing single articles, one at a time, in a variety of modes of different product delivery. Such products specifically may be supported in single or double columns with a given product in each of such columns selectively arranged in single or multiple stack depth arrangements, specifically, single, double or triple stack depth arrangements as may be desired by a user of the vending machine. The flexibility and capacity of such machines which incorporate this invention are thereby maximized within seemingly incompatible and varying parameters of (a) potentially desirable minimum content of high demand flavors and (b) increased variety of available flavor selection.

As will be apparent to persons skilled in the art, various modifications, adaptations and variations of the foregoing specific disclosure can be made without departing from the teachings of this invention.

I claim:

1. An adjustable vending apparatus for delivering different products and comprising a power operated, rotary actuator shaft having a plurality of gears fixed thereon, and a plurality of rotary dispensing shafts each having a gear fixed thereon and meshingly engageable with a gear of the actuator shaft, each gear of the actuator shaft normally being in a vend position engaging a gear of a dispensing shaft for a given product delivery, and each gear of the actuator shaft being retractable into an adjust position in disengaged relation to its dispensing shaft gear for selectively adjusting the relative angular position of that dispensing shaft for a product delivery changeover.

2. The apparatus of claim 1 wherein the dispensing shafts are each individually freewheeling when its respective actuator shaft gear is in retracted adjust position whereby each dispensing shaft is rotatable during such changeover to a predetermined angular position for a given product delivery.

3. The apparatus of claim 1 wherein the actuator shaft and its gears are movable as a unit between said vend and adjust positions.

4. The apparatus of claim 1 wherein the actuator shaft and its gears are reciprocable relative to the axis of the actuator shaft between said vend and adjust positions.

5. The apparatus of claim 1 wherein each dispensing shaft has a helical scroll protruding thereon for product storage and release.

6. The apparatus of claim 1 wherein each dispensing shaft is rotatable in a common angular direction responsive to rotation of the actuator shaft in one angular direction when the actuator shaft is in its normal vend position.

7. The apparatus of claim 1 wherein the actuator shaft gears are coaxially fixed thereto in spaced relation, and wherein the individual dispensing shafts are supported in spaced relation to one another for rotation about vertical axes in perpendicular relation to the actuator shaft.

8. The apparatus of claim 1 further including a motor driven drive mechanism drivingly connected to the actuator shaft for selectively rotating the same, the drive mechanism including a clutch and resilient biasing means cooperating with the clutch to maintain the actuator shaft in its normal vend position with the actuator shaft gears in meshing engagement with the gears of the dispensing shafts.

9. The apparatus of claim 8 wherein the resilient biasing means includes a spring continuously urging the actuator shaft into its normal vend position, the clutch being movable against a biasing force of its spring upon axially moving the actuator shaft manually from its normal vend position toward said retracted adjust position.

10. The apparatus of claim 1 wherein a frame is provided for supporting the actuator shaft for rotation and for axial reciprocation between its normal vend position and said retracted adjust position, and wherein the frame includes a member in fixed overlying relation to the dispensing shafts for supporting the same in an aligned array perpendicular to the actuator shaft.

11. The apparatus of claim 10 further including partitions extending in parallel relation to the dispensing shaft array and defining columns for receiving and storing product on a selected side of the dispensing shaft array to alternatively provide a single column or a double column therefor, the dispensing shaft array including a sufficient number of dispensing shafts for selectively loading product in a single, a double or a triple stack depth arrangement.

12. The apparatus of claim 11 wherein the partitions are spaced apart to define a single column on each side of the dispensing shaft array and include a center partition aligned therewith such that the product supported on a selected side of the dispensing shaft array is disposed in overlying relation to one another.

13. The apparatus of claim 1 wehrein the dispensing shafts each are of identical size and shape and formed with an identical scroll, and wehrein the gears of the dispensing shafts each are of identical pitch, size and shape and wherein the gears of the actuator shaft are each of identical pitch, size and shape.

14. The apparatus of claim 13 wherein the dispensing shaft gears and the actuator shaft gears are each of identical pitch, size and shape and are interchangeable.

15. The apparatus of claim 1 wherein the dispensing shafts each are of identical size and shape, the dispensing shafts each having a helical screw formed theron with a scroll direction and pitch identical to that of the other dispensing shafts, the dispensing shafts each being interchangeable.

16. The apparatus of claim 15 wherein the scrolls of the dispensing shafts of each dispensing mechanism have a common lead and drop-off point, wherein the dispensing shafts each have a timing band identical to that of the other dispensing shafts, and wherein each dispensing shaft may be individually positioned, when the actuator shaft is in its retracted adjust position, by selective registration of its timing band in relation to a fixed reference mark for sequencing the drop-off point of each dispensing shaft in timed relation to that of the other dispensing shafts for a predetermined product stack depth arrangment and selected product loading on either or both sides of the dispensing shaft array in a single column or a double column arrangement.

17. The apparatus of claim 1 further including a motor driven drive mechanism drivingly connected to the actuator shaft and selectively operable responsive to a product dispensing signal, the drive mechanism including a clutch for maintaining the actuator shaft and drive mechanism in driving relation regardless of the actuator shaft position while permitting manual movement of the actuator shaft between its normal vend position and its retracted adjust position, the relative angular positions of the dispensing shafts being adjustable for a different product delivery when the actuator shaft is in retracted adjust position with the drive mechanism being maintained by said clutch in assembled relation to the actuator shaft.

18. An adjustable vending apparatus for dispensing one product at a time from a single column or a double column of products positioned selectively in single, double or triple stack depth arrangements, the apparatus comprising a frame, a plurality of dispensing shafts supported in aligned relation for rotation on the frame, the dispensing shafts each having a protruding helix formed thereon, the helix of each shaft being selectively positioned for predetermined product delivery in timed relation to the other dispensing shafts, a power operated actuator shaft rotatably supported on the frame, a selectively engageable driving connection between the actuator shaft and each of the dispensing shafts, the actuator shaft being mounted on the frame for axial reciprocable movement between a normal vend position and a retracted adjust position, the actuator shaft in normal vend position causing the driving connection to establish driving engagement of the actuator shaft respectively with each of the dispensing shafts, the actuator shaft in retracted adjust position effecting disengagement of the driving connection between the actuator shaft and the dispensing shafts, the dispensing shafts being individually freewheeling in said retracted adjust position of the actuator shaft, whereby the dispensing shafts may be selectively positioned for a given product delivery.

19. The vending apparatus of claim 18 further including a motor driven mechanism drivingly connected to the actuator shaft and including a sliding clutch operatively cooperating with the actuator shaft and resiliently biasing it into said normal vend position, the clutch permitting the actuator shaft to be manually moved axially between said normal vend position and said retracted adjust position to selectively engage and disengage the driving connection between the actuator shaft and each of the dispensing shafts.

20. The vending apparatus of claim 19 wherein the clutch includes retaining means for temporarily retaining the actuator shaft in said retracted adjust position during selective positioning of the dispensing shafts for a given product delivery.

* * * * *